US007413277B2

(12) United States Patent
Kim

(10) Patent No.: US 7,413,277 B2
(45) Date of Patent: Aug. 19, 2008

(54) METHOD FOR CONTROLLING NOZZLE POSITION IN IMAGE FORMING APPARATUS

(75) Inventor: Tae-young Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 242 days.

(21) Appl. No.: 10/998,933

(22) Filed: Nov. 30, 2004

(65) Prior Publication Data

US 2005/0122365 A1 Jun. 9, 2005

(30) Foreign Application Priority Data

Dec. 3, 2003 (KR) ..... 10-2003-87384

(51) Int. Cl.
*B41J 29/393* (2006.01)

(52) U.S. Cl. ..... 347/19; 347/9; 347/16

(58) Field of Classification Search ..... 347/9, 347/19, 16, 85, 86, 5, 12
See application file for complete search history.

(56) References Cited

U.S. PATENT DOCUMENTS 5,600,350 A 2/1997 Cobbs et al. ..... 347/19
6,302,506 B1 10/2001 Norton ..... 347/14
6,428,131 B1 8/2002 Fujii et al. ..... 347/7
6,450,608 B2 9/2002 Sarmast et al. ..... 347/19

FOREIGN PATENT DOCUMENTS

EP 1034936 A2 9/2000

*Primary Examiner*—Lam S Nguyen
(74) *Attorney, Agent, or Firm*—Roylance, Abrams, Berdo & Goodman, LLP

(57) ABSTRACT

A method of controlling the position of nozzles in an ink-jet type image forming apparatus. Positional information for the nozzles at the time of print-driving the image forming apparatus is calculated by combining a first positional information with a second positional information, wherein the first positional information is measured with reference to a nozzle plate and then recorded as reference information from among various positional information for an effective detection area, which is defined as an area on a print medium measured by a light receiving part of the detection sensor in terms of the amount of reflected light. The second positional information for the effective detection area is measured with reference to a predetermined position of the print medium at the time of print-driving and is variable depending on the movement of the nozzle plate. Accordingly, the relative positional information for the nozzle plate can be accurately set, thereby more accurately controlling the position of the nozzle plate.

17 Claims, 8 Drawing Sheets

METHOD FOR CONTROLLING NOZZLE POSITION IN IMAGE FORMING APPARATUS

CROSS-REFERENCE TO RELATED APPLICATIONS

This application claims the benefit under 35 U.S.C. §119 (a) of Korean Patent Application No. 2003-87384 filed in the Korean Intellectual Property Office on Dec. 3, 2003, the entire contents of which are incorporated herein by reference.

BACKGROUND OF THE INVENTION

1. Field of the Invention

The present invention relates to a method for controlling the nozzle position in an ink-jet type image forming apparatus comprising nozzles for printing an image. More particularly, the present invention relates to a method for controlling the position of nozzles which move in relation to a print medium at the time of print-driving the image forming apparatus.

2. Description of the Related Art

Conventionally, image forming apparatus print an image on a print medium in response to print data input thereto, and, according to the type of printing, are classified into an ink-jet type which prints an image using an ink-jet process, and an electrophotographic type which prints an image using an electrophotographic process. Among these types, ink-jet type image forming apparatus are those for printing images by directly ejecting ink onto a print medium, as found in an ink-jet printer and a plotter.

Referring to FIG. 1 which shows a conventional ink-jet printer, an ink-jet type image forming apparatus 100 comprises a printing engine 130 for printing an image on a print medium P (see FIG. 2), a paper feeding device 120 for containing plural print mediums and for feeding the print mediums sheet by sheet while the image forming apparatus is print-driven, a paper transfer device with a plurality of rollers 151 and 153, and a control section (not shown) for controlling the respective driving sections for the above-mentioned devices. The printing engine 130 comprises a reciprocating carriage 131 installed within a printer body 110, one or more ink cartridges 133 for containing ink which are removably mounted in the carriage 131, and one or more nozzle plates 135 (see FIG. 2) for ejecting ink onto a print medium P. Each nozzle plate 135 is provided with a plurality of nozzles (not shown) for ejecting ink. For reference, an image forming apparatus for printing a multi-colored image may comprise a plurality of such cartridges and nozzle plates, wherein the number of cartridges and nozzle plates corresponds to the number of colors required for printing such an image. In addition, a nozzle plate 135 may be formed integral with an ink cartridge 133 as shown in FIG. 2, or integral with a carriage 131, although not shown in the drawings. Symbols S and B, which are not specifically described herein, respectively designate a guide shaft S and a belt B for guiding the movement of the carriage 131.

The image forming apparatus 100 configured as described above further comprises a detection sensor 137 for detecting an edge PE of a print medium at the time of print-driving as shown in FIG. 2. The detection sensor 137 is used for determining a size of a print medium, determining a blank space in a print medium corresponding to a size of an image to be printed, and controlling a nozzle position in relation to a print medium. For such a detection sensor 137, an optical detection sensor is generally used, which comprises a light source (not shown) and a light receiving part (not shown).

The positional information detected as described above is provided by the detection sensor 137 with respect to an edge PE of a print medium. Accordingly, the distances D1 and D2 of the detection sensor 137 from the nozzle plates 135, which are preset at the time of fabricating an image forming apparatus, are set as reference information, and the positions of the nozzles in relation to a print medium P are then monitored by combining the positional information of the detection sensor 137 measured in relation to the print medium P, and the reference information.

However, if the distances D1 and D2 between the nozzle plates 135 and the detection sensor 137, which are preset at the time of fabricating such an image forming apparatus, are used as reference information as described above, several problems can exist in that it is difficult to acquire accurate positional information for the nozzles. Such difficulties can be due to manufacturing tolerances, center deviations D3 between the detection sensor 137 and an effective detection area A, wherein the effective detection area A is a detected area practically detected by the detection sensor 137, variations of the distances D1 and D2 caused by any change in operating circumstances of the image forming apparatus, and replacement of the ink cartridges 133, or the like.

To this effect, other problems can then arise because the nozzle position is inaccurately controlled, such as the quality of print may become deteriorated and images may not be accurately adjusted and printed to a size corresponding to a blank space of a print medium as demanded by a user.

Accordingly, a need exists for a method to control nozzle position in relation to a print medium which can further compensate for variations, such as manufacturing tolerances, the replacement of articles of consumption such as ink cartridges, and any changes in operating circumstances of the image forming apparatus, to thereby prevent the quality of images from being deteriorated.

SUMMARY OF THE INVENTION

Accordingly, the present invention has been provided to solve the above-mentioned and other problems occurring in the conventional devices. An object of the present invention is to provide a method for controlling the position of nozzles in an image forming apparatus, which enables positional information of a detection sensor, which provides reference information for controlling the position of the nozzles in the process of printing an image, to be accurately set in accordance with various circumstances and which also enables the positional information of the detection sensor to be corrected as needed.

In order to achieve the above-mentioned objects, a method is provided for controlling a nozzle position in an image forming apparatus. The apparatus comprises a nozzle plate provided with a plurality of nozzles and an optical detection sensor located adjacent to the nozzle plate, wherein positional information for the nozzles moving at the time of print-driving the image forming apparatus is calculated. The positional information is calculated by combining a first positional information with a second positional information. The first positional information comprises information regarding an effective detection area measured with reference to the nozzle plate and which is then recorded as a reference information from among various positional information for the effective detection area, wherein the effective detection area is defined as a detected area on a print medium measured by a light receiving part of the detection sensor in terms of the amount of reflected light. The second positional information for the effective detection area is measured with reference to a predetermined position of the print medium at the time of print-driving.

According to an embodiment of the present invention, the second positional information is variable depending on the movement of the nozzle plate and is preferably measured with reference to an edge of the print medium, which moves in a position facing the nozzle plate while an image is printed.

In addition, the embodiments of the present invention may further comprise a method for accurately setting the position of the nozzles through the steps of a) inputting a predetermined test pattern on the print medium, b) measuring a distance from the effective detection area at the time of starting the printing of the test pattern to the test pattern along a first coordinate axial direction, c) measuring a distance from the effective detection area at the time of printing the test pattern to the test pattern along a second coordinate axial direction, d) calculating positional information on an orthogonal coordinate system consisting of the first and second coordinate axes by combining the distances measured in steps b) and c), and e) recording the positional information calculated in step d) as the first positional information, whereby the first positional information is set.

It is preferable that the distances measured through the afore-mentioned steps are moving or travel distances of the detection sensor until the amount of reflected light reaches a predetermined level while the detection sensor is moved in relation to the print medium to measure the amount of reflected light. The resulting first positional information is relative positional information of the center of the effective detection area in relation to the center of the test pattern.

According to an embodiment of the present invention, the first positional information is calculated on the basis of first, second, third and fourth distances, wherein the first and third distances are individually measured from the edges which are the farthest from the effective detection area in the first and second coordinate axial directions to the center of the effective detection area, and wherein the second and fourth distances are the halves of the widths of the test pattern measured in the first and second coordinate axial directions, respectively.

According to another embodiment of the present invention, the method further comprises the steps of f) measuring the output signal output from the light receiving part while moving the detection sensor in relation to the test pattern from one side edge of the test pattern to the other side edge of the test pattern along the first and second coordinate axial directions, g) calculating the central position of the test pattern located between an output signal ascending area and an output signal descending area, h) setting the level of the output signal measured at a position spaced from the central position by second and fourth distances as a reference level, wherein the second and fourth distances correspond to halves of the preset widths of the test pattern measured in the first and second axial directions, respectively, i) returning the detection sensor to its initial position where the printing of the test pattern was started, and j) moving the detection sensor along the first and second coordinate axial directions to measure the first and third distances which are the distances from the initial position to the positions where the output signal arrives at the reference level, wherein the first positional information is calculated on the basis of each of the first and third distances measured in step j) and each of the second and fourth distances measured in step i).

The central position of the test pattern is preferably calculated by adding or subtracting the halves of the preset widths of the test pattern from the points which are positioned in the output signal ascending area and output signal descending area, respectively, at which the output signal has a same level in a corresponding coordinate axial direction, and of which the distances are substantially identical to the preset widths of the test pattern in the first and second coordinate axial directions, respectively.

It is also preferable that one of the first and second coordinate axial directions is parallel to the moving direction of the nozzle plate for printing the image, and the other is parallel to the moving direction of the print medium for printing the image. In addition, it is also preferable that the detection sensor is fixed at a predetermined position and that the print medium is reciprocated in the print medium-discharging direction and the opposite direction in step c).

If the image forming apparatus is not capable of reciprocating the print medium in the opposite direction, or back-feeding, it is still further preferable that the test pattern is printed two or more times along the discharging direction of the print medium.

If the test pattern is located and printed on the first and second axes extending from the center of the effective detection area, it is then preferable that the detection of the first and second distances be executed by moving the detection sensor in relation to the print medium from the initial position along the first and second coordinate axial directions.

Additionally, if the test pattern is located and printed at a position spaced from the first coordinate axis, it is then preferable that the detection sensor be moved in relation to the print medium from the initial position along the second coordinate axial direction so that the test pattern is positioned on the first coordinate axis, and that the detection sensor then measures the first distance while being moved in relation to the print medium in the first coordinate axial direction.

Moreover, if the test pattern is located and printed at a position spaced from the second coordinate axis, it is then preferable that the detection sensor be moved in relation to the print medium from the initial position along the first coordinate axial direction so that the test pattern is positioned on the second coordinate axis, and that the detection sensor then measures the second distance while being moved in relation to the print medium in the second coordinate axial direction.

It is also preferable that the distances between the centers of the effective detection area and the test pattern along the first and second coordinate axial directions be substantially identical to the distances between the centers of the effective detection area and the nozzle plate along the first and second coordinate axial directions, respectively.

In addition, if the image forming apparatus comprises plural nozzle plates, it is still further preferable that the first positional information for each nozzle plate be repeatedly set.

BRIEF DESCRIPTION OF THE DRAWINGS

The above aspects and features of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Certain embodiments of the present invention will now be described in greater detail with reference to the accompanying drawings.

Figure 1:
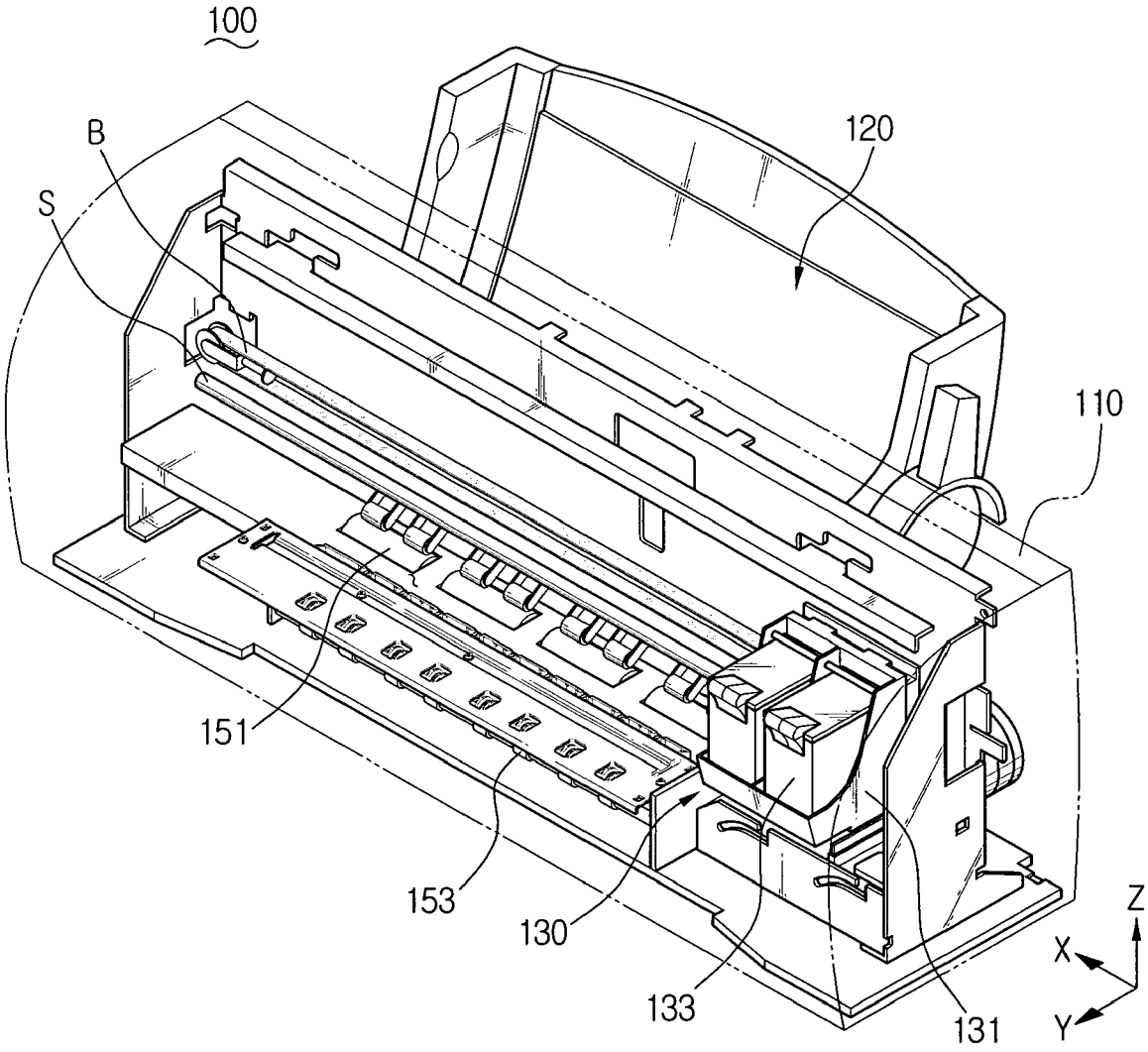
FIG. 1 (PRIOR ART)
FIG. 1 is a perspective view showing the interior of a conventional ink-jet printer.

Hereinbelow, exemplary embodiments of the present invention will be described in greater detail with reference to the accompanying drawings. For reference, the components of the inventive image forming apparatus which are substantially the same in function and construction as those of the conventional image forming apparatus described above and shown FIGS. 1 and 2 are given same reference numerals as those used above, and detailed descriptions thereof are omitted when describing the embodiments of the present invention below.

The control of a nozzle position in an image forming apparatus according to an exemplary embodiment of the present invention is executed on the basis of positional information calculated by setting a first positional information (X4, Y4) (see FIG. 3A), which is a relative positional information of a detection sensor 137 in relation to the nozzles, and then processing the first positional information along with a second positional information, which is a relative positional information of the detection sensor 137 measured on the basis of a print medium P (see FIG. 2) at the time of print-driving. In this example, the first positional information is obtained using an effective detection area A (see FIG. 2), which is an area wherein the amount of reflected light is measured by a light receiving part from among plural areas on a print medium illuminated by light projected from a light source of the detection sensor 137. Such an effective detection area is used because a position detected by the detection sensor 137 indicates an effective detection area which may be different from the practical position of the detection sensor and thus, using the relationship between such an effective detection area and a nozzle plate is more accurate than using the relationship between the nozzle plate and the detection sensor in setting the first positional information serving as the reference for measuring the position of the nozzle plate.

The process for calculating the first positional information according to the first embodiment of the present invention will now be described in greater detail with reference to the accompanying drawings.

Figure 2:
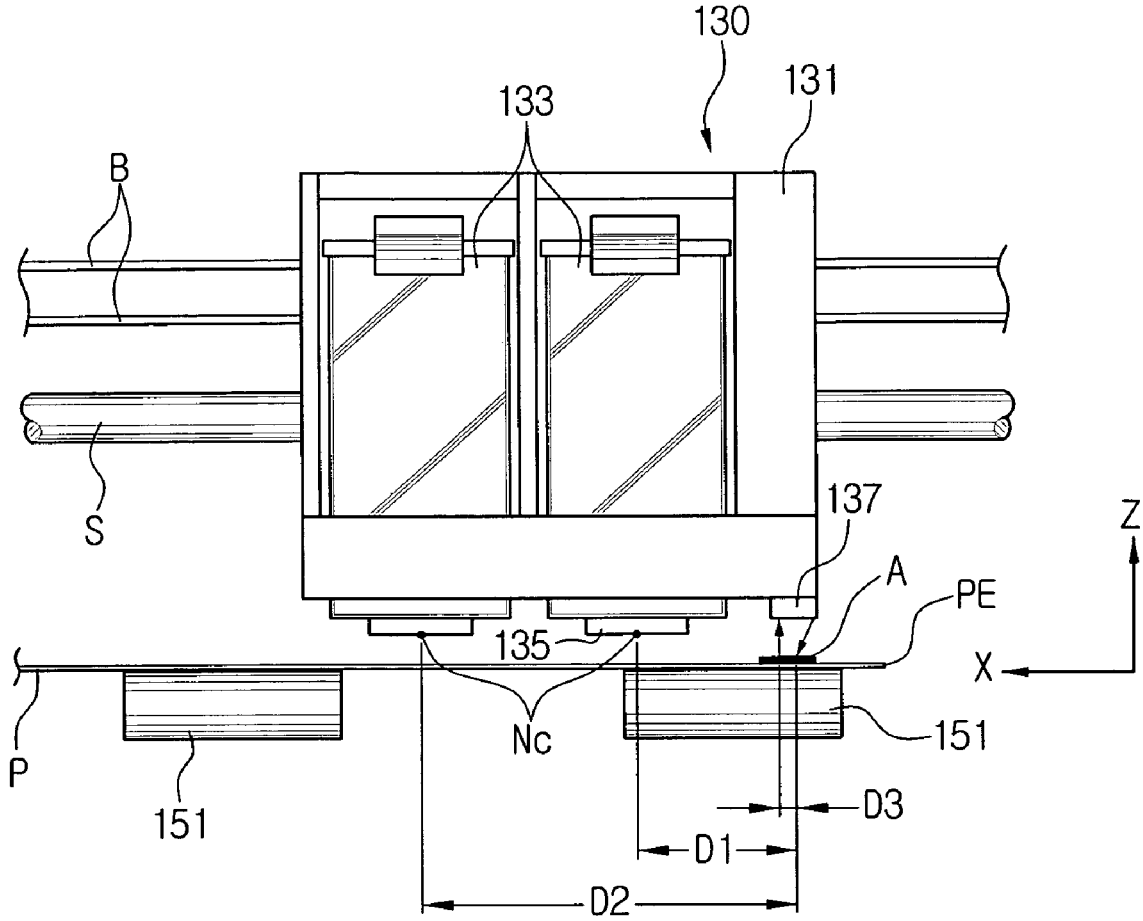
FIG. 2 (PRIOR ART)
FIG. 2 is a front view showing in detail a number of components of the ink-jet printer shown in FIG. 1 in order to describe a conventional method for controlling nozzle position.

Firstly, if the setting of a first positional information is demanded through a user's manipulation or the starting of the image forming apparatus, the control section controls the paper feeding device 120 and the paper transferring device so that a print medium P is transferred and placed below a nozzle plate 135 as shown in FIG. 2.

Figure 3A:
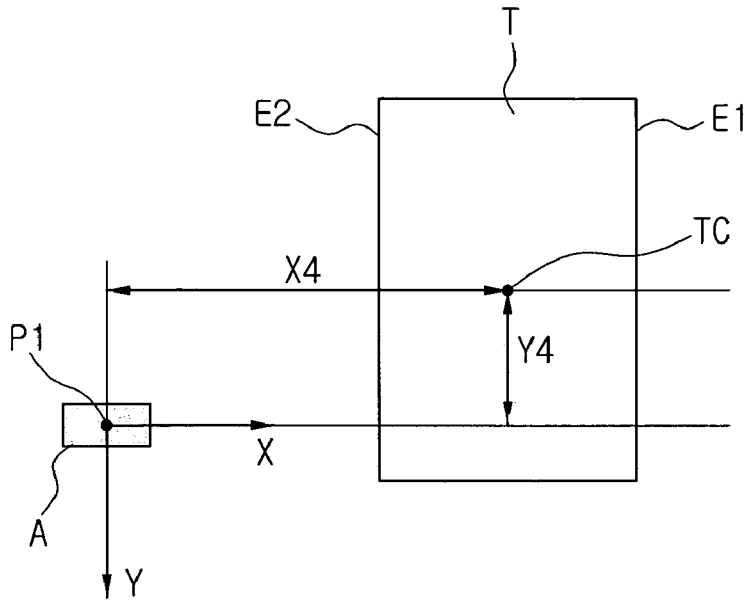
FIGS. 3A to 3F are sequential step-by-step views showing a method for controlling nozzle position according to a first embodiment of the present invention.

The control section then controls the nozzle plate 135 so that a predetermined test pattern T as shown in FIG. 3A is printed on the print medium P. Here, the center TC of the test pattern T, and the center Nc of the nozzle plate 135 (see FIG. 2) are preferably coaxially arranged along the axis Z (see FIG. 2) normal to the print medium P. As such, the distances from the center of the detection sensor 137 to the center of the nozzle plate 135 along the X and Y directions will be substantially the same as the distances from the center of the detection sensor 137 to the center of the test pattern T along the X and Y directions, respectively.

Figure 4:
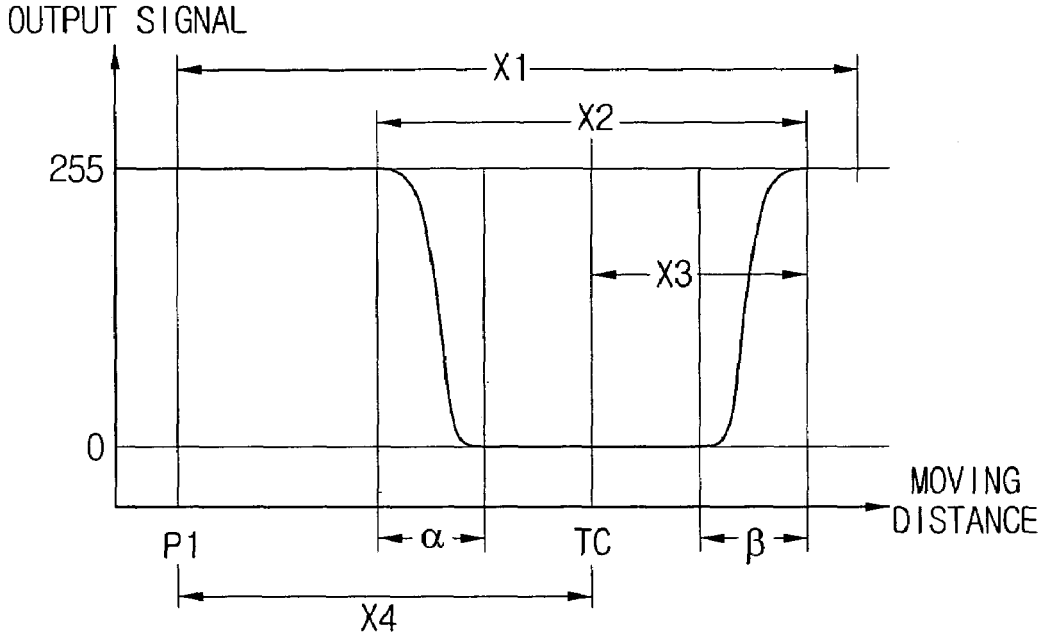
FIG. 4 is a graph showing a variation of an output signal of a detection sensor depending on the movement of the detection sensor according to the first embodiment of the present invention.

Once the printing of the test pattern is completed, the control section then controls the detection sensor 137 to illuminate light from the light source toward the print medium P, and then moves the carriage 131 (see FIG. 2) along a first axial direction X, which is the carriage moving direction at the time of print-driving the image forming apparatus. Accordingly, the detection sensor 137 is moved along with the carriage 131, and consequently, the effective detection area A is also moved in the carriage moving direction. At this point, the light receiving part of the detection sensor 137 measures the amount of light reflected from the moving effective detection area A on the print medium P and outputs a signal corresponding to the measured amount of light. The signal is output as an electrical signal, wherein the electric voltage of the electrical signal becomes lowest when the effective detection area A is on the test pattern T as the detection sensor 137 moves, and becomes highest when the effective detection area A is positioned on an area where an image, such as the test pattern T, is not printed. In this regard, FIG. 4 exemplifies how the output signal is varied in intensity depending on the moving distance of the effective detection area A as described above. For reference, it can be seen from FIG. 4 that the output signal is varied at areas $\alpha$ and $\beta$, which correspond to the edges of the test pattern T, respectively.

The movement of the effective detection area A as described above is continued until reaching the edge E1 of the test pattern T which is farthest from the first initial position P1 in the first coordinate axial direction X. Such detection is effected using the intensity variation of the output signal of the light receiving part as described above. When the edge E1 of the test pattern is detected as described above, the control section calculates and records the relative moving distance X1 of the effective detection area A along the first coordinate axial direction X.

Figure 3B:
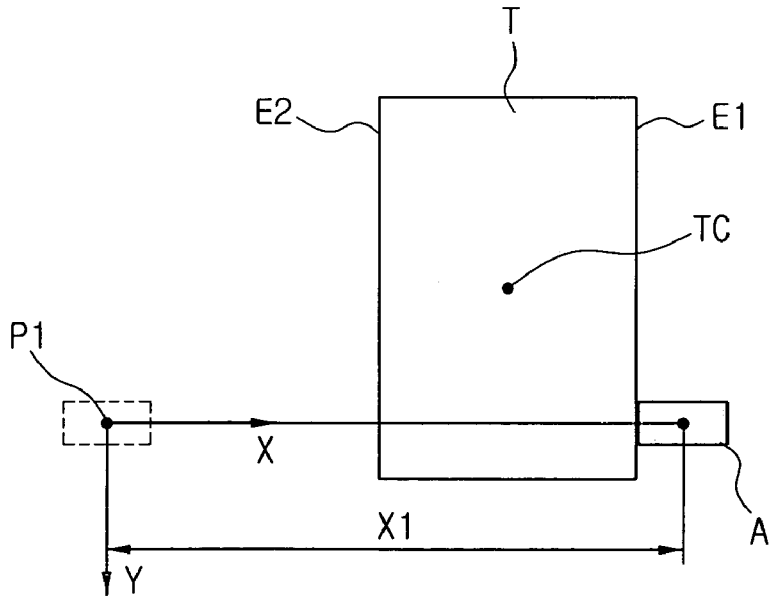
Figure 3C:
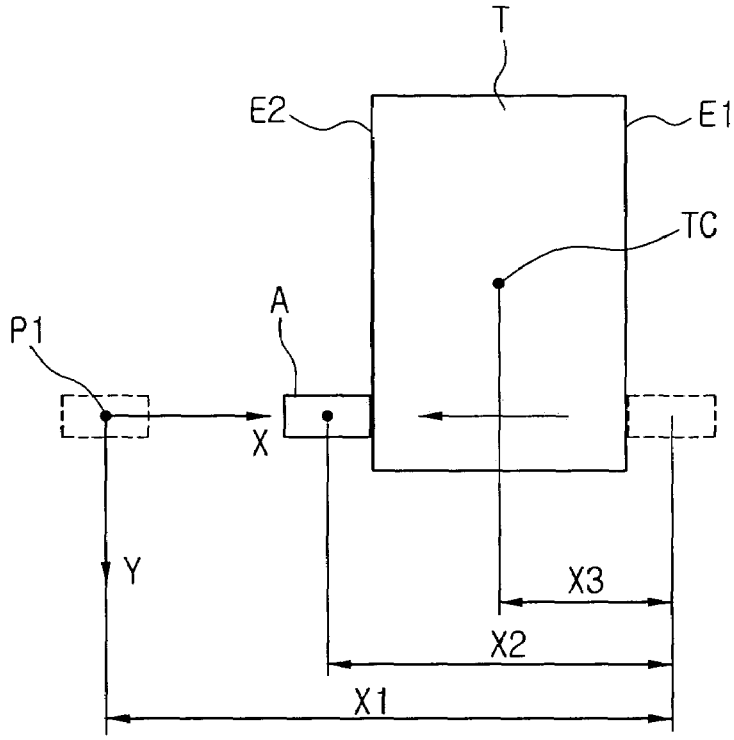

When the calculation of the moving distance X1 of the effective detection area A is completed, the control section measures the width X2 of the test pattern T along the first coordinate axial direction X using the measuring process as described above but while moving the detection sensor 137 in the direction opposite to the first coordinate axial direction X shown in FIG. 3B. For reference, the width X2 of the test pattern T measured in this embodiment is the moving distance between the positions where the output signal of the light receiving part has highest values, and wherein the measured width X2 may be somewhat larger than the practical width of the test pattern T.

When the measurement of the width X2 of the test pattern T is completed, the control section calculates the half value X3 of the width X2 of the test pattern T, and then subtracts the half value X3 from the moving distance X1 of the effective detection area A, thereby calculating a first distance X4 (see FIG. 3A), which is the distance from the center P1 of the effective detection area A at the initial position, to the center TC of the test pattern T. The control section then records the first distance as a first coordinate value (X4, 0).

Figure 3D:
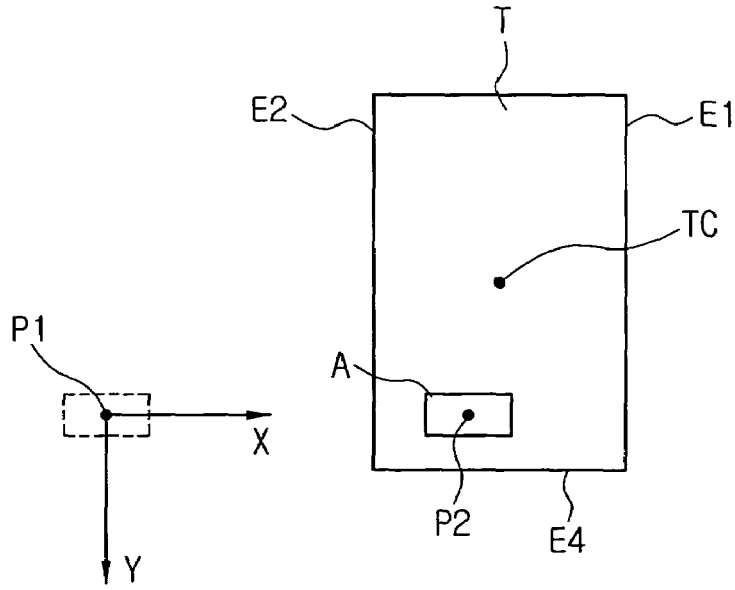
Figure 3E:
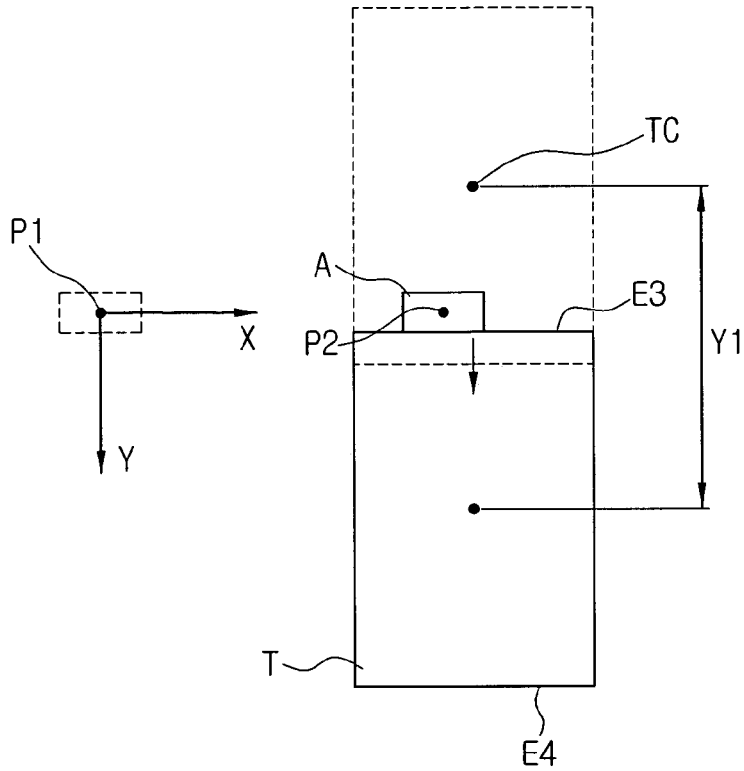

When the calculation of the first distance X4 is completed, the control section then moves the carriage so that the effective detection area A is positioned at a second initial position P2 on the test pattern as shown in FIG. 3D. The control section then controls the paper transfer device to move the print medium in the paper-discharging direction, that is, in the second coordinate axial direction Y perpendicular to the first coordinate axial direction X as shown in FIG. 3E. Such movement of the print medium is continued until an edge E3 of the test pattern T is measured. Once the edge E3 is measured, the control section then calculates the relative moving distance Y1 of the effective detection area from the center of the effective detection area A positioned at the second initial position P2 to the edge E3. Because this relative moving distance Y1 of the effective detection area A is equal to the moving distance of the center TC of the test pattern, the moving distance of the center TC of the test pattern is illustrated rather than the relative moving distance of the effective detection area A in FIG. 3E providing a more clear illustration of the measurement.

For reference, the movement of a print medium as described above may be employed if the image forming apparatus is an ink-jet printer. However, with an image forming apparatus such as a plotter, in which a nozzle plate is capable of moving in the first and second coordinate axial directions, it is possible to acquire the same measurement results as those described above by directly moving the detection sensor 137 without moving the print medium.

Figure 3F:
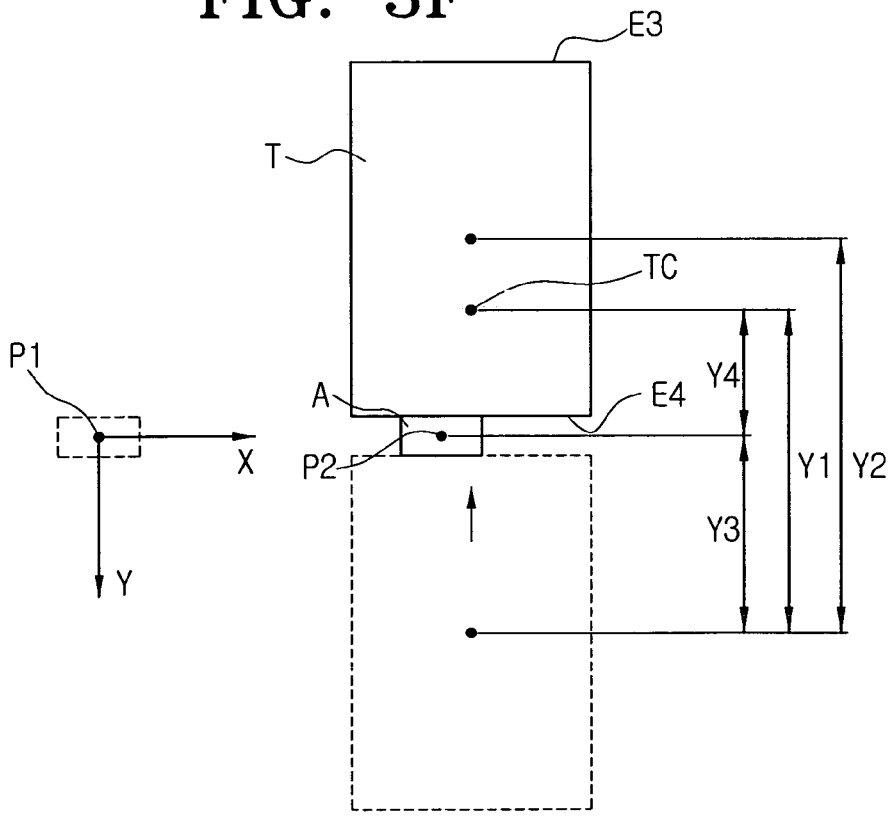

Once the calculation of the moving distance Y1 of the effective detection area A is completed, the control section then controls the paper transfer device to move the print medium in the direction opposite to the paper-discharging direction as shown in FIG. 3F to measure the width Y2 of the test pattern T, and then determine the half value Y3 of the width Y2 of the test pattern. When the half value Y3 is calculated, the control section subtracts the half value Y3 from the moving distance Y1 of the effective detection area A, thereby calculating a second distance Y4 (see FIG. 3A), which is the distance from the center of the effective detection area A positioned at the second initial position P2, to the center TC of the test pattern T. The control section then records the second distance Y4 as a second coordinate value (0, Y4). For reference, where an image forming apparatus is not capable of moving a print medium in the reverse direction as described above, it is then preferable to coaxially print plural print patterns (not shown) along the second coordinate axial direction and to measure the moving distances Y1 and Y2 of the effective detection area using the respective test patterns.

When the calculation of the first and second distances X4 and Y4 is completed as described above, the control section then combines the first and second coordinate values. The coordinate value obtained by combining the first and second coordinate values in this manner indicates a coordinate value calculated for the center P1 position of the effective detection area A when positioned at the first initial position, relative to the center TC of the test pattern TC. This coordinate value is then recorded as a first positional information of the detection sensor 137 in relation to a nozzle plate 135. As previously described, the first positional information will be used as reference information for subsequently controlling the nozzle position.

Figure 5:
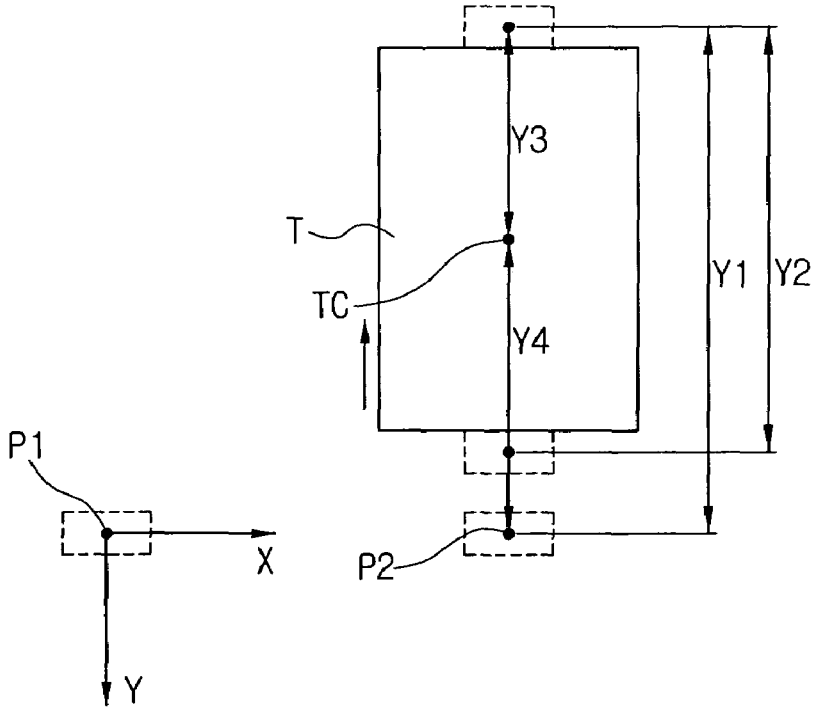
FIG. 5 is a view showing the initial positions of an effective detection area and a predetermined test pattern according to a second embodiment of the present invention.

The exemplary embodiments described above have been described having a predetermined test pattern T that is printed at a position lying on the first coordinate axis X extending from the center of an effective detection area A, but spaced from the second coordinate axis Y as shown in FIG. 3A. However, the positions of the detection sensor 137 and the nozzle plate 135 may be varied from the positions described above. For example, the test pattern T may be printed at a position spaced from the first coordinate axis X and lying on the second coordinate axis Y. In such an example, it is preferable to first measure the distance Y4 between the center P1 of the effective detection area A and the center TC of the test pattern T along the second coordinate axis Y, and then to measure the distance X4 between the center of the effective detection area A and the center TC of the test pattern T after moving the effective detection area A along the second coordinate axis Y, so that the effective detection area A is positioned on the test pattern T. In addition, even where the test pattern T is spaced from both the first and second coordinate axes X and Y extending from the center of the effective detection area A as in the second embodiment of the present invention shown in FIG. 5, the measurement can be performed in a substantially similar manner as described above. That is, it is possible to measure first positional information corresponding to various positions of the detection sensor 137. Moreover, substantially similar positional information can be obtained even where the measurement of the moving distances X1 and Y1 and the measurement of the widths of the test pattern X2 and Y2 are changed.

A description regarding a method for measuring the first positional information is described in greater detail below according to the third embodiment of the present invention.

Figure 6A:
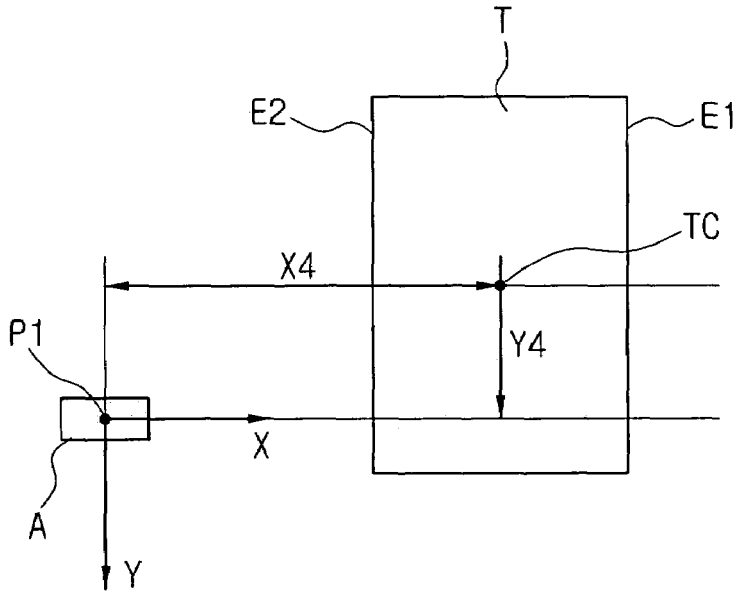
FIGS. 6A to 6C are sequential step-by-step views showing a method for controlling nozzle position according to a third embodiment of the present invention.

Firstly, as shown in FIG. 6A, a predetermined test pattern T is printed on a print medium as in the first embodiment.

Figure 6B:
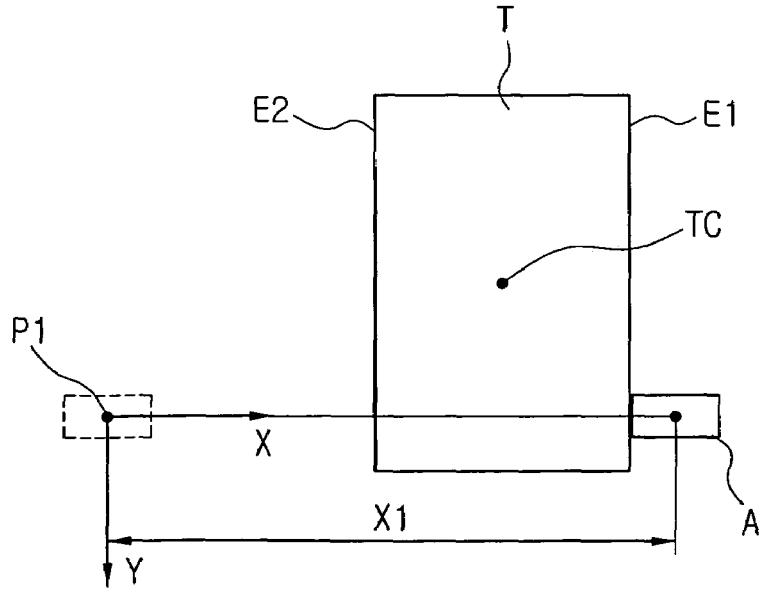
Figure 6C:
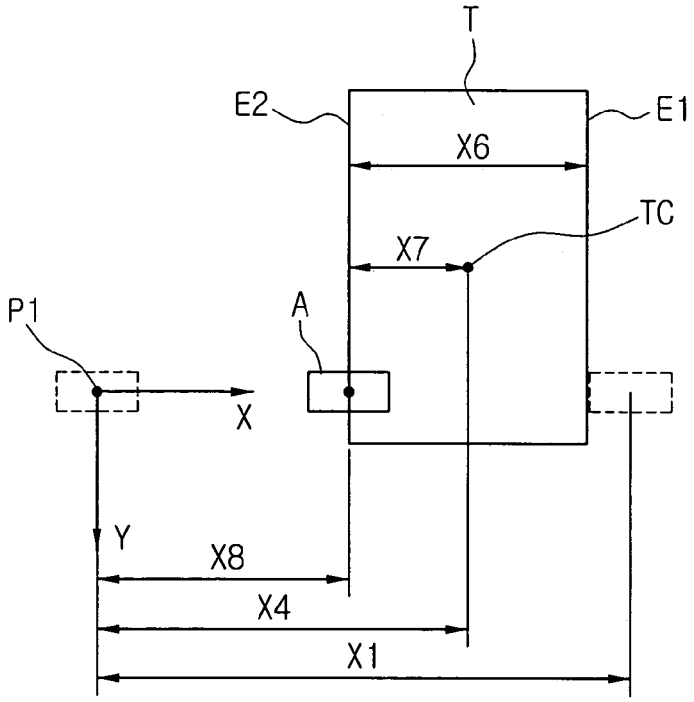
Figure 7:
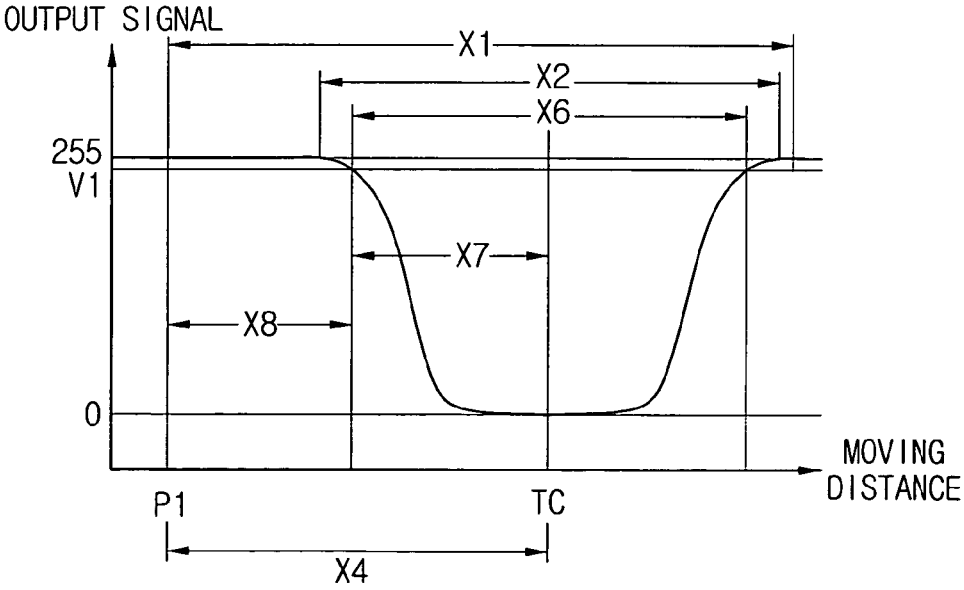
FIG. 7 is a graph showing a variation of an output signal of the detection sensor depending on the movement of the detection sensor according to the third embodiment of the present invention.

Thereafter, as shown in FIG. 6B, a signal output from a light receiving part is monitored while moving an effective detection area A along the first coordinate axis X. At this point, the movement of the effective detection area A is continued up to or beyond a side edge E1 so that it is possible to measure at least the entire width of the test pattern T, although the movement may be varied depending on the initial position P1 of the effective detection area A. Once the movement is completed and a resulting signal output as shown in FIG. 7 is obtained, the control section compares the preset width X6 for the practical test pattern, with the measured result and then sets the level of the output signal corresponding to the width X6 of the practical test pattern as a reference level V1.

Once the reference level V1 is set as described above, the effective detection area A is then moved to the first initial position P1 which is the position at which the printing of the test pattern was started, and the detection sensor 137 is then moved along the first coordinate axis X until the output signal reaches at the reference level V1, wherein the moving distance X8 is calculated.

Once the moving distance X8 of the effective detection area A along the first coordinate axial direction X is calculated, the distance between the center P1 of the effective detection area A at the first initial position, and the center TC of the test pattern T is then calculated by summing the half value X7 of the preset width X6 of the test pattern and the moving distance X8, and this value is then recorded as the first distance X4.

Once the measurement of the first distance X4 is completed as described above, the detection sensor 137 is then moved along the first coordinate axis X so that the test pattern T is positioned on the second coordinate axis Y. The second distance Y4 along the second coordinate axis is then calculated and recorded in a substantially similar manner as the first distance X4 described above. The method for calculating the second distance Y4 is substantially the same as that for calculating the first distance X4 except that the moving direction of the effective detection area A is changed. Accordingly, a detailed description thereof is omitted.

The method for setting the first positional information according to the third embodiment of the present invention can preferably be enabled only when the size of a predetermined test pattern is accurately known and set in advance. To that effect, a predetermined test pattern in this embodiment is arranged so that the centers of the test pattern T and a nozzle plate 135 are coaxially positioned, and the test pattern T is printed in a size substantially equal with that of the nozzle plate 135. If the test pattern T is formed having a shape symmetrical in every direction with reference to the center of the test pattern, few difficulties may exist. In such a case, however, it is often difficult to accurately set the practical size of the test pattern T. Therefore, it is preferable to print the test pattern T to conform to the preset size of the test pattern.

As described above, according to the present invention, it is possible to accurately set reference information required for controlling the nozzle position using a predetermined test pattern and an effective detection area, which is an area measured by the a detection sensor in terms of the amount of light reflected from the area. In addition, the present invention allows the renewal of such reference information to be executed as needed.

Accordingly, even where the positions of a nozzle plate and a detection sensor are varied due to manufacturing tolerances in an image forming apparatus, the replacement of articles of consumption such as ink cartridges, and any changes in operating circumstances of the image forming apparatus, it is possible to compensate for such variations thereby preventing the quality of images from being deteriorated.

The foregoing embodiments and advantages are merely exemplary and are not to be construed as limiting the present invention. The present teaching can be readily applied to other types of apparatus. Also, the descriptions of the embodiments of the present invention are intended to be illustrative, and not to limit the scope of the claims, and many alternatives, modifications, and variations will be apparent to those skilled in the art.

What is claimed is:

1. A method for controlling a nozzle position in an image forming apparatus comprising a nozzle plate provided with a plurality of nozzles and an optical detection sensor located adjacent to the nozzle plate, in which a nozzle position information is measured with reference to a datum position and varied in accordance with the nozzle plate moving during the printing operation of the image forming apparatus, such that the nozzle position information is calculated by adding a first positional information of the datum position obtained using an effective detection area with a second positional information which is measured in a real-time basis during movement of the nozzle plate, and the position information of the effective detection area being defined to be a subject area to the detection and from which an amount of reflected light is measured at a light receiving part of the optical detection sensor, the method further comprising the steps of:

a) printing a predetermined test pattern on a print medium;

b) measuring a distance from the effective detection area at the time of starting the printing of the test pattern to the test pattern along a first coordinate axial direction;

c) measuring a distance from the effective detection area at the time of starting the printing of the test pattern to the test pattern along a second coordinate axial direction;

d) calculating positional information on an orthogonal coordinate system consisting of the first and second coordinate axial directions by combining the distances measured in steps b) and c); and e) recording the positional information calculated in step d) as the first positional information.

2. A method for controlling a nozzle position as claimed in claim 1, further comprising the steps of:

measuring the second positional information with reference to an edge of a print medium, wherein the print medium is moved while in a position facing the nozzle plate while an image is printed.

3. A method for controlling a nozzle position as claimed in claim 1, wherein the first positional information comprises relative positional information of the center of the effective detection area in relation to the center of the test pattern.

4. A method for controlling a nozzle position as claimed in claim 3, wherein the distances measured in steps b) and c) comprise moving distances of the detection sensor until the amount of reflected light measured by the detection sensor reaches a predetermined level while the detection sensor is moved in relation to the print medium to measure the amount of reflected light.

5. A method for controlling a nozzle position as claimed in claim 4, wherein the step of calculating the first positional information further comprises the step of:

calculating the first positional information on the basis of first, second, third and fourth distances, wherein, the first and third distances are individually measured from edges farthest from the effective detection area in the first and second coordinate axial directions to the center of the effective detection area, respectively; and the second and fourth distances are halves of the widths of the test pattern measured in the first and second coordinate axial directions, respectively.

6. A method for controlling a nozzle position as claimed in claim 4, further comprising the steps of:

f) measuring the output signal output from the light receiving part while moving the detection sensor in relation to the test pattern from one side edge of the test pattern to the other side edge of the test pattern along the first and second coordinate axial directions;

g) calculating the central position of the test pattern located between an output signal ascending area and an output signal descending area;

h) setting the level of the output signal measured at a position spaced from the central position by the second and fourth distances as a reference level, wherein the second and fourth distances correspond to halves of the preset widths of the test pattern measured in the first and second axial directions, respectively;

i) returning the detection sensor to its initial position, wherein the printing of the test pattern was started; and j) moving the detection sensor along the first and second coordinate axial directions to measure the first and third distances which are the distances from the initial position to the positions where the output signal reaches at the reference level, wherein the first positional information is calculated on the basis of the first and third distances measured in step j) and the second and fourth distances measured in step i).

7. A method for controlling a nozzle position as claimed in claim 6, further comprising the step of:

calculating the central position of the test pattern by selectively adding or subtracting the halves of the preset widths of the test pattern from the points which are positioned in the output signal ascending area and output signal descending area, respectively, wherein the points are detected where the output signal has a same level in a corresponding coordinate axial direction.

8. A method for controlling a nozzle position as claimed in claim 7, wherein the distance between the points is substantially equal to the preset widths of the test pattern in the first and second coordinate axial directions, respectively.

9. A method for controlling a nozzle position as claimed in claim 1, wherein one of the first and second coordinate axial directions is parallel to the moving direction of the nozzle plate for printing the image, and the other is parallel to the moving direction of the print medium for printing the image.

10. A method for controlling a nozzle position as claimed in claim 9, wherein the coordinate axial direction is parallel to the moving direction of the nozzle plate and the second coordinate axial direction is parallel to the moving direction of the print medium.

11. A method for controlling a nozzle position as claimed in claim 10, wherein in step c), the detection sensor is fixed at a predetermined position and the print medium is reciprocated in at least one of the print medium-discharging direction and an opposite direction.

12. A method for controlling a nozzle position as claimed in claim 10, wherein the test pattern is printed two or more times along the discharging direction of the print medium.

13. A method for controlling a nozzle position as claimed in claim 10, further comprising the step of:

detecting the first and second distances by moving the detection sensor in relation to the print medium from the initial position along the first and second coordinate axial directions if the test pattern is located and printed on the first and second axes extending from the center of the effective detection area.

14. A method for controlling a nozzle position as claimed in claim 10, further comprising the steps of:

moving the detection sensor in relation to the print medium from the initial position along the second coordinate axial direction so that the test pattern is positioned on the first coordinate axis if the test pattern is located and printed at a position spaced from the first coordinate axis; and measuring the first distance by moving the detection sensor in relation to the print medium in the first coordinate axial direction.

15. A method for controlling a nozzle position as claimed in claim 10, further comprising the steps of:

moving the detection sensor in relation to the print medium from the initial position along the first coordinate axial direction so that the test pattern is positioned on the second coordinate axis if the test pattern is printed at a position spaced from the second coordinate axis; and measuring the second distance by moving the detection sensor in relation to the print medium in the second coordinate axial direction.

16. A method for controlling a nozzle position as claimed in claim 1, wherein the relative positional information of the center of the effective detection area in relation to the center of the test pattern is substantially equal to the relative positional information of the center of the effective detection area in relation to the center of the nozzle plate.

17. A method for controlling a nozzle position as claimed in claim 16, further comprising the step of:

repeatedly setting the first positional information for each nozzle plate if the image forming apparatus comprises plural nozzle plates.

* * * * *